US009506381B2

(12) United States Patent
Kubani et al.

(10) Patent No.: US 9,506,381 B2
(45) Date of Patent: Nov. 29, 2016

(54) SYSTEM AND METHOD FOR MEASURING VALVE LIFT AND FOR DETECTING A FAULT IN A VALVE ACTUATOR BASED ON THE VALVE LIFT

(71) Applicant: GM Global Technology Operations LLC, Detroit, MI (US)

(72) Inventors: Ronald J. Kubani, Highland, MI (US); Scott T. Feldmann, South Lyon, MI (US); Donovan L. Dibble, Utica, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 272 days.

(21) Appl. No.: 14/260,608

(22) Filed: Apr. 24, 2014

(65) Prior Publication Data

US 2015/0218978 A1 Aug. 6, 2015

Related U.S. Application Data

(60) Provisional application No. 61/934,238, filed on Jan. 31, 2014.

(51) Int. Cl.
*F01L 1/00* (2006.01)
*F01L 13/00* (2006.01)

(52) U.S. Cl.
CPC ..... *F01L 13/0015* (2013.01); *F01L 2013/11* (2013.01)

(58) Field of Classification Search
CPC ..... F01L 2013/11; F01L 13/0015
See application file for complete search history.

(56) References Cited

U.S. PATENT DOCUMENTS 5,109,675 A * 5/1992 Hwang ..... G05B 9/02 251/129.04

OTHER PUBLICATIONS

Anonymously Disclosed, "Variable Valve Lift Diagnostic Using the Spring Retainer as a Hall Effect Sensor Target", Research Disclosure database No. 590025, Published Jun. 2013, 2 pages.

* cited by examiner

*Primary Examiner* — Zelalem Eshete

(57) ABSTRACT

A system according to the principles of the present disclosure includes a valve lift determination module and a fault detection module. The valve lift determination module determines valve lift based on at least one of a first period when a valve is open and N differences between a first value of a valve lift signal generated by a valve lift sensor when the valve is closed and a second value of the valve lift signal when the valve is open, wherein N is an integer greater than one. The fault detection module detects a fault in a valve actuator based on the valve lift.

28 Claims, 6 Drawing Sheets

SYSTEM AND METHOD FOR MEASURING VALVE LIFT AND FOR DETECTING A FAULT IN A VALVE ACTUATOR BASED ON THE VALVE LIFT

CROSS-REFERENCE TO RELATED APPLICATIONS

This application claims the benefit of U.S. Provisional Application No. 61/934,238, filed on Jan. 31, 2014. The disclosure of the above application is incorporated herein by reference in its entirety.

FIELD

The present disclosure relates to systems and methods for measuring valve lift and for detecting a fault in a valve actuator based on the valve lift.

BACKGROUND

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Internal combustion engines combust an air and fuel mixture within cylinders to drive pistons, which produces drive torque. Air flow into the engine is regulated via a throttle. In spark-ignition engines, the throttle adjusts throttle area, which increases or decreases air flow into the engine. As the throttle area increases, the air flow into the engine increases. A fuel control system adjusts the rate that fuel is injected to provide a desired air/fuel mixture to the cylinders and/or to achieve a desired torque output. Increasing the amount of air and fuel provided to the cylinders increases the torque output of the engine.

In spark-ignition engines, spark initiates combustion of an air/fuel mixture provided to the cylinders. In compression-ignition engines, compression in the cylinders combusts the air/fuel mixture provided to the cylinders. Spark timing and air flow may be the primary mechanisms for adjusting the torque output of spark-ignition engines, while fuel flow may be the primary mechanism for adjusting the torque output of compression-ignition engines.

SUMMARY

A system according to the principles of the present disclosure includes a valve lift determination module and a fault detection module. The valve lift determination module determines valve lift based on at least one of a first period when a valve is open and N differences between a first value of a valve lift signal generated by a valve lift sensor when the valve is closed and a second value of the valve lift signal when the valve is open, wherein N is an integer greater than one. The fault detection module detects a fault in a valve actuator based on the valve lift.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

A valvetrain controls the operation of a valve in an engine. In some cases, the valvetrain may control the amount by which the valve is lifted, referred to as valve lift. A valve lift sensor outputs a valve lift signal, such as a voltage signal, indicating the valve lift. The valve lift may be determined based on the valve lift signal and a fault in the valvetrain may be detected when the valve lift is different than expected.

The valve lift may be determined based on a single difference between a maximum value of the valve lift signal and a minimum value of the valve lift signal. However, determining the valve lift in this manner may lead to inaccuracies in the valve lift due to an insufficient signal-to-noise ratio associated with the valve lift signal. Inaccuracies in the valve lift may cause false detections of a fault in the valvetrain.

A system and method according to the present disclosure determines valve lift based on a valve lift signal generated by a valve lift sensor, such as a voltage signal, and detects a fault in the valvetrain when the valve lift is different than expected. In one example, the system and method measures the valve lift based on a ratio of a first period when a valve is open and a sum of the first period and a second period when the valve is closed. In another example, the system and method measures valve lift based on multiple differences between the output voltage of the valve lift sensor when the valve is closed and the output voltage of the valve lift sensor when the valve is open.

Determining the valve lift in these ways may improve the accuracy of the valve lift despite the signal-to-noise ratio of the valve lift signal, and thereby prevent false detections of a fault in the valvetrain. In addition, the system and method may improve the signal-to-noise ratio of the valve lift signal by learning the output voltage of the valve lift sensor when the valve is closed and normalizing the output voltage based on the learn voltage. For example, the system and method may multiply the output voltage by a ratio of a nominal voltage to the learned voltage to normalize the output voltage. Although the system and method is described in the context of an engine, the system and method may be employed to measure valve lift and detect a fault in a valve actuator other than a valvetrain of an engine, such as a valve actuator of water pump.

Figure 1:
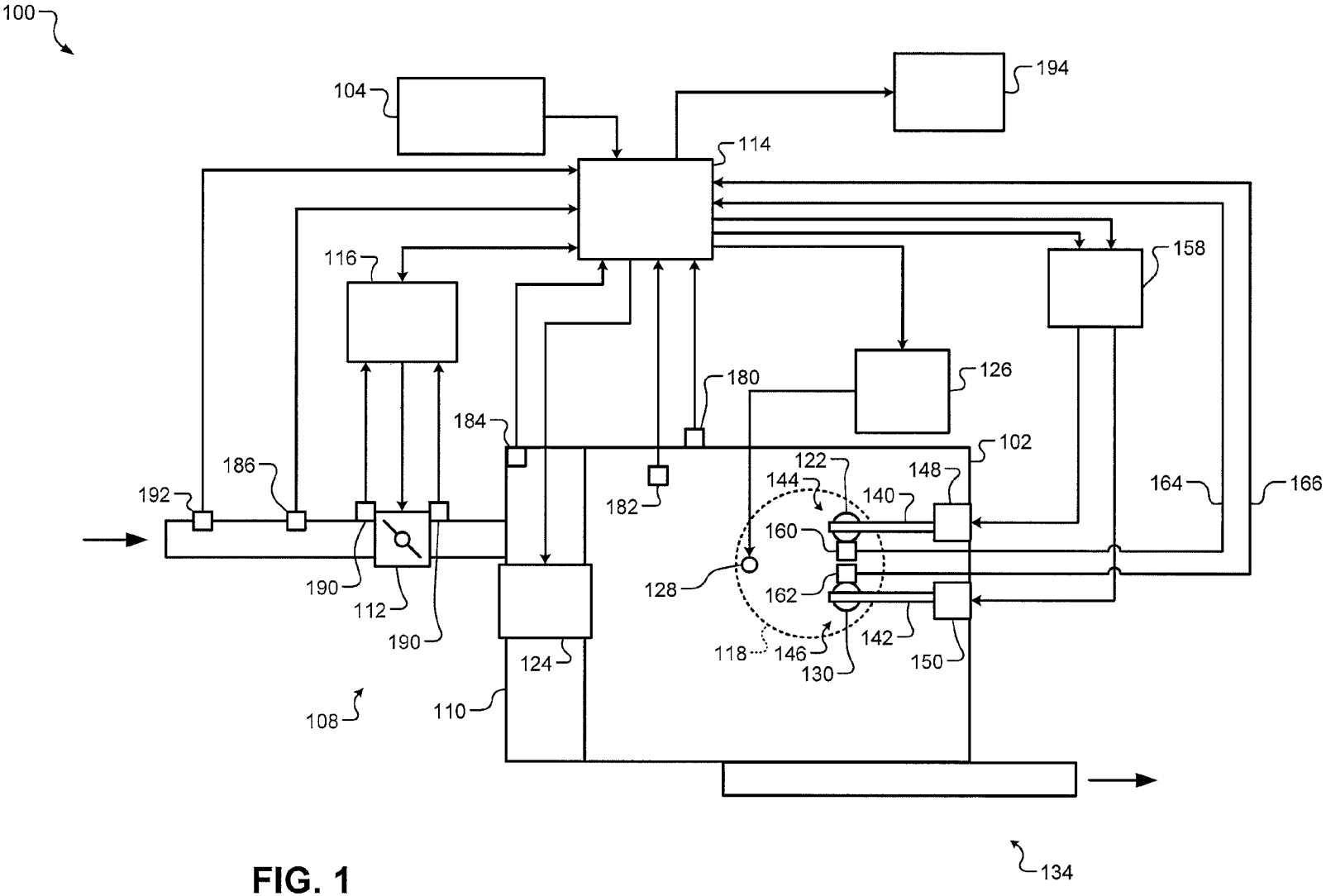
FIG. 1 is a functional block diagram of an example engine system according to the principles of the present disclosure.

Referring now to FIG. 1, an engine system 100 includes an engine 102 that combusts an air/fuel mixture to produce drive torque for a vehicle. The amount of drive torque produced by the engine 102 is based on a driver input from a driver input module 104. The driver input may be based on a position of an accelerator pedal. The driver input may also be based on a cruise control system, which may be an adaptive cruise control system that varies vehicle speed to maintain a predetermined following distance.

Air is drawn into the engine 102 through an intake system 108. The intake system 108 includes an intake manifold 110 and a throttle valve 112. The throttle valve 112 may include a butterfly valve having a rotatable blade. An engine control module (ECM) 114 controls a throttle actuator module 116, which regulates opening of the throttle valve 112 to control the amount of air drawn into the intake manifold 110.

Air from the intake manifold 110 is drawn into cylinders of the engine 102. While the engine 102 may include multiple cylinders, for illustration purposes a single representative cylinder 118 is shown. For example only, the engine 102 may include 2, 3, 4, 5, 6, 8, 10, and/or 12 cylinders. The ECM 114 may deactivate some of the cylinders, which may improve fuel economy under certain engine operating conditions.

The engine 102 may operate using a four-stroke cycle. The four strokes, described below, are named the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes.

During the intake stroke, air from the intake manifold 110 is drawn into the cylinder 118 through an intake valve 122. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations, fuel may be injected directly into the cylinders or into mixing chambers associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression in the cylinder 118 ignites the air/fuel mixture. Alternatively, the engine 102 may be a spark-ignition engine, in which case a spark actuator module 126 energizes a spark plug 128 to generate a spark in the cylinder 118 based on a signal from the ECM 114, which ignites the air/fuel mixture. The timing of the spark may be specified relative to the time when the piston is at its topmost position, referred to as top dead center (TDC).

The spark actuator module 126 may be controlled by a spark timing signal specifying how far before or after TDC to generate the spark. Because piston position is directly related to crankshaft rotation, operation of the spark actuator module 126 may be synchronized with crankshaft angle. In various implementations, the spark actuator module 126 may halt provision of spark to deactivated cylinders.

Generating the spark may be referred to as a firing event. The spark actuator module 126 may have the ability to vary the timing of the spark for each firing event. The spark actuator module 126 may even be capable of varying the spark timing for a next firing event when the spark timing signal is changed between a last firing event and the next firing event. In various implementations, the engine 102 may include multiple cylinders and the spark actuator module 126 may vary the spark timing relative to TDC by the same amount for all cylinders in the engine 102.

During the combustion stroke, combustion of the air/fuel mixture drives the piston down, thereby driving the crankshaft. The combustion stroke may be defined as the time between the piston reaching TDC and the time at which the piston returns to bottom dead center (BDC). During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. The intake valve 122 and the intake camshaft 140 may be part of an intake valvetrain 144, while the exhaust valve 130 and the exhaust camshaft 142 may be part of an exhaust valvetrain 146. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118).

The time at which the intake valve 122 is opened may be varied with respect to piston TDC by an intake cam phaser 148. The time at which the exhaust valve 130 is opened may be varied with respect to piston TDC by an exhaust cam phaser 150. A valve actuator module 158 may control the intake and exhaust cam phasers 148 and 150 based on signals from the ECM 114. When implemented, variable valve lift may also be controlled by the valve actuator module 158.

The valve actuator module 158 may switch the intake and exhaust valvetrains 144 and 146 between a first lift state and a second lift state. The intake and exhaust valvetrains 144 and 146 may lift the intake and exhaust valves 122 and 130 by a first amount when operating in the first lift state. The intake and exhaust valvetrains 144 and 146 may lift the intake and exhaust valves 122 and 130 by a second amount that is greater than the first amount when operating in the second lift state.

The valve actuator module 158 may deactivate the cylinder 118 by disabling opening of the intake valve 122 and/or the exhaust valve 130. The valve actuator module 158 may disable opening of the intake valve 122 by decoupling the intake valve 122 from the intake camshaft 140. Similarly, the valve actuator module 158 may disable opening of the exhaust valve 130 by decoupling the exhaust valve 130 from the exhaust camshaft 142. In various implementations, the valve actuator module 158 may control the intake valve 122 and/or the exhaust valve 130 using devices other than camshafts, such as electromagnetic or electrohydraulic actuators.

The lift of the intake valve 122 may be measured using an intake valve lift sensor 160, while the lift of the exhaust valve 130 may be measured using an exhaust valve lift sensor 162. The intake valve lift sensor 160 may output an intake valve lift (IVL) signal 164 indicating the intake valve lift, while the exhaust valve lift sensor 162 may output an exhaust valve lift (EVL) signal 166 indicating the exhaust valve lift. The intake and exhaust valve lift signals 164 and 166 may be voltage signals.

The position of the crankshaft may be measured using a crankshaft position (CKP) sensor 180. The temperature of the engine coolant may be measured using an engine coolant temperature (ECT) sensor 182. The ECT sensor 182 may be located within the engine 102 or at other locations where the coolant is circulated, such as a radiator (not shown). The pressure within the intake manifold 110 may be measured using a manifold absolute pressure (MAP) sensor 184. In various implementations, engine vacuum, which is the difference between ambient air pressure and the pressure within the intake manifold 110, may be measured.

The mass flow rate of air flowing into the intake manifold 110 may be measured using a mass air flow (MAF) sensor 186. In various implementations, the MAF sensor 186 may be located in a housing that also includes the throttle valve 112. The throttle actuator module 116 may monitor the position of the throttle valve 112 using one or more throttle position sensors (TPS) 190. The ambient temperature of air being drawn into the engine 102 may be measured using an intake air temperature (IAT) sensor 192.

The ECM 114 uses signals from the sensors to make control decisions for the engine system 100 and to detect a fault in the intake and exhaust valvetrains 144 and 146. The ECM 114 may activate a service indicator 194 when a fault in the intake or exhaust valvetrain 144 or 146 is detected. When activated, the service indicator 194 indicates that service is required using a visual message (e.g., text, a light, and/or a symbol), an audible message (e.g., a chime), and/or a tactile message (e.g., vibration).

Figure 2:
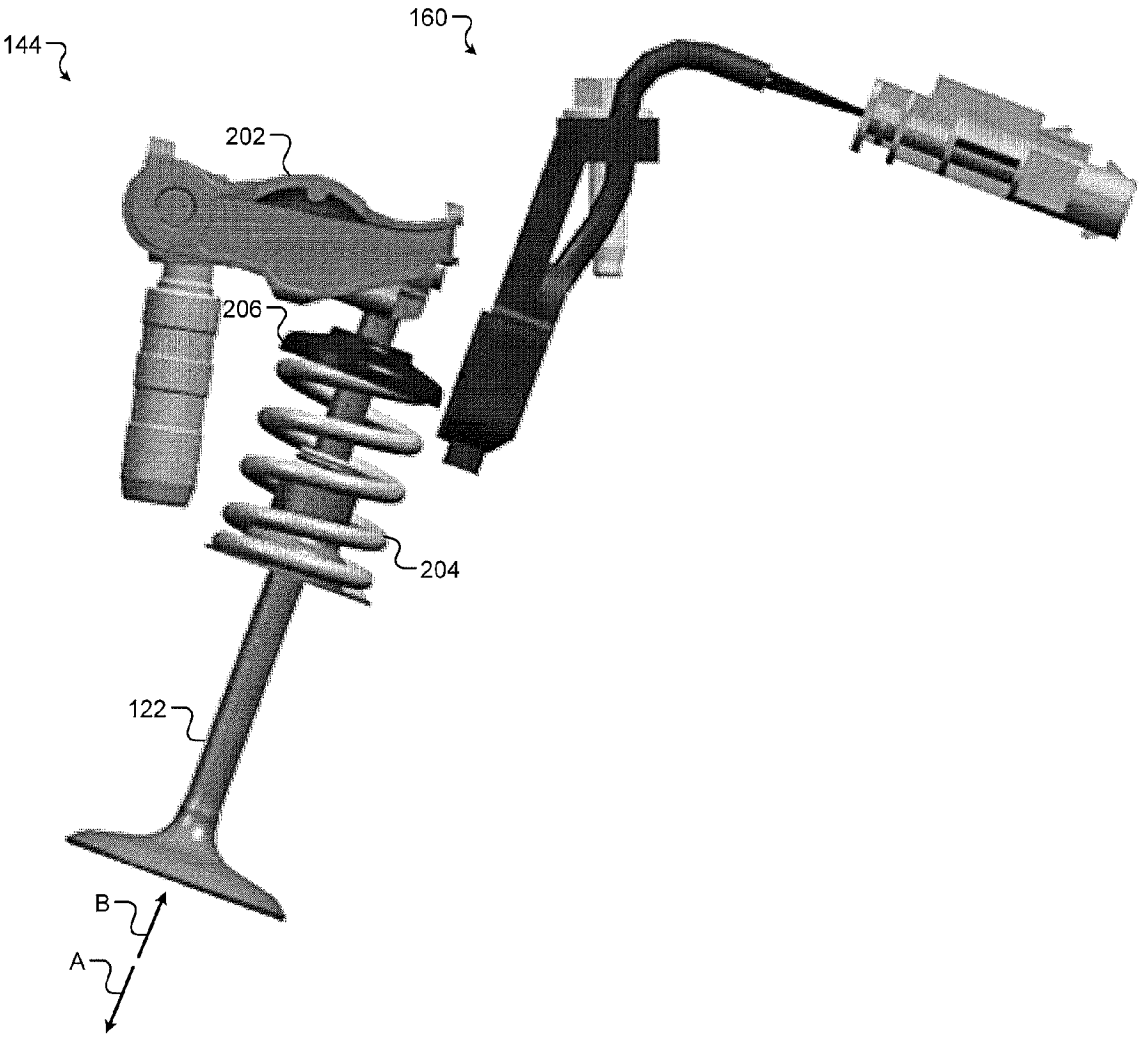
FIG. 2 is a side view of an example valvetrain and an example valve lift sensor according to the principles of the present disclosure.

Referring now to FIG. 2, example implementations of the intake valvetrain 144 and the intake valve lift sensor 160 are illustrated. While only the intake valvetrain 144 and intake valve lift sensor 160 are shown, the exhaust valvetrain 146 and the exhaust valve lift sensor 162 may be similar. The intake valvetrain 144 includes the intake valve 122, the intake camshaft 140 (FIG. 1), a rocker arm 202, a valve spring 204, and a spring retainer 206. When a lobe on the intake camshaft 140 engages the rocker arm 202, the rocker arm 202 moves the intake valve 122 in a direction A and thereby opens the intake valve 122. When the lobe disengages from the rocker arm 202, the valve spring 204 biases the spring retainer 206 to move the intake valve 122 in a direction B and thereby close the intake valve 122.

The intake valve lift sensor 160 may include a Hall Effect sensor and a magnet. The Hall Effect sensor may output a voltage in response to a magnetic field created by the magnet and/or a variation in the magnetic field. The output voltage of the Hall Effect sensor may makeup the intake valve lift signal 164. The Hall Effect sensor may be placed near the magnet and the spring retainer 206 so that the strength of the magnetic field changes as the intake valve 122 opens. The change in the magnetic field strength changes the output voltage of the Hall Effect sensor.

The ECM 114 (FIG. 1) determines the intake valve lift based on the intake valve lift signal 164. The ECM 114 may compare the intake valve lift to a valve lift range and detect a fault in the intake valvetrain 144 when the intake valve lift is outside of the valve lift range. The valve lift range may be determined based on a valve lift command sent from the ECM 114 to the valve actuator module 158. The ECM 114 may determine the exhaust valve lift and detect a fault in the exhaust valvetrain 146 in a similar manner.

Figure 3:
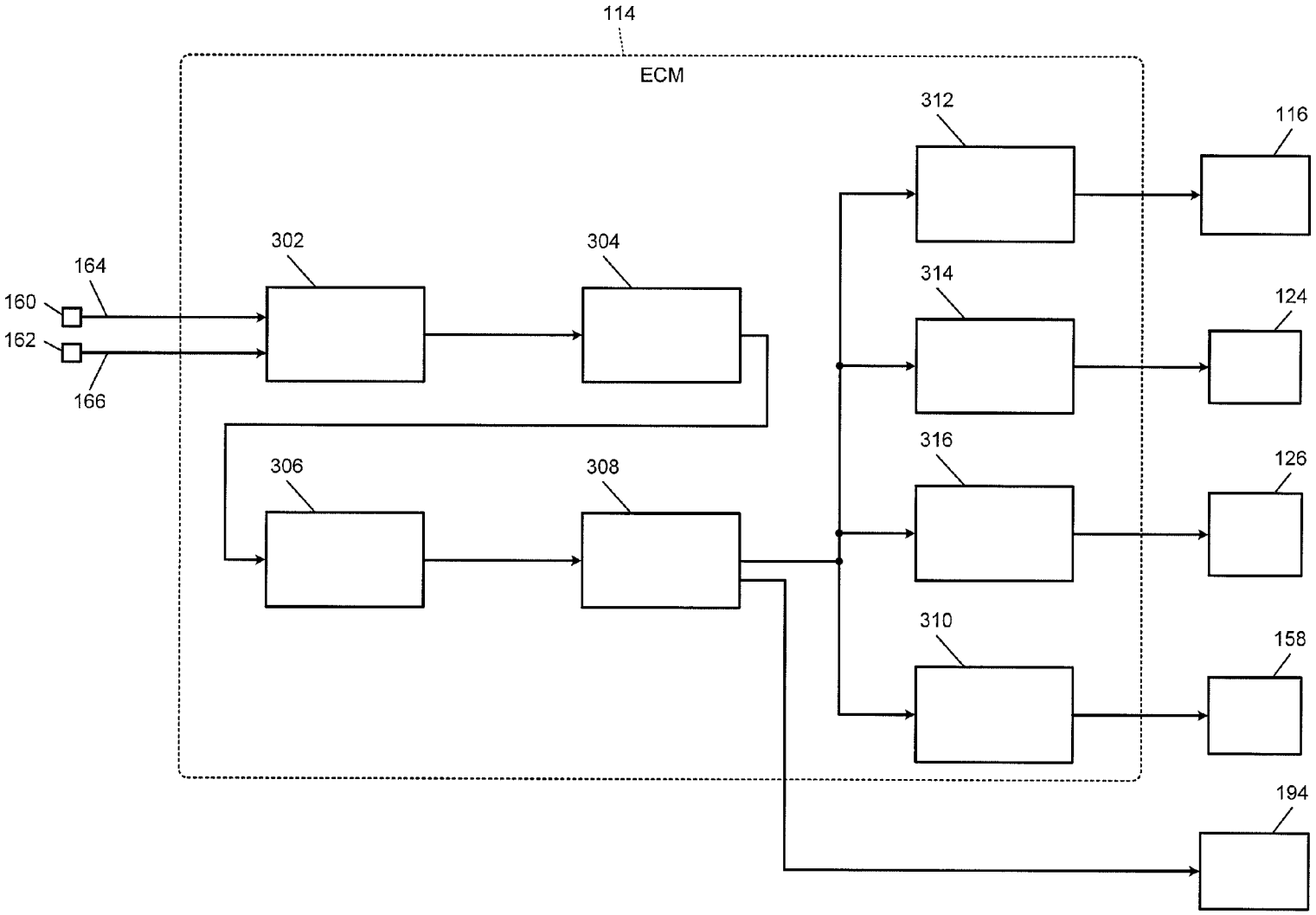
FIG. 3 is a functional block diagram of an example control system according to the principles of the present disclosure.

Referring now to FIG. 3, an example implementation of the ECM 114 includes a sensor voltage determination module 302. The sensor voltage determination module 302 determines or learns the output voltage of the intake valve lift sensor 160 when the intake valve 122 is closed. The sensor voltage determination module 302 also determines or learns the output voltage of the exhaust valve lift sensor 162 when the exhaust valve 130 is closed.

In one example, the sensor voltage determination module 302 takes samples from the intake valve lift signal 164 over a predetermined period (e.g., 2 seconds). The value of the intake valve lift signal 164 may increase as the intake valve 122 closes. Thus, the sensor voltage determination module 302 may learn the output voltage of the intake valve lift sensor 160 based on (an average of) a predetermined number (e.g., 50) of the samples that are greater than all of the other samples. To avoid noise in the samples, the sensor voltage determination module 302 may discard a predetermined percent (e.g., 10 percent) of the predetermined number of samples that are greater than the remainder of the predetermined number of samples. The sensor voltage determination module 302 may learn the output voltage of the exhaust valve lift sensor 162 in a similar manner.

A sensor voltage normalization module 304 normalizes the output voltage of the intake valve lift sensor 160 based on the learned voltage at the closed position of the intake valve 122. The sensor voltage normalization module 304 may normalize the output voltage of the exhaust valve lift sensor 162 in a similar manner. Normalizing the output voltages of the intake and exhaust valve lift sensors 160 and 162 compensates for variation in the intake and exhaust valve lift signals 164 and 166 due to, for example, a sensor air gap and/or sensor-to-sensor variation.

The sensor voltage normalization module 304 may normalize the output voltage of the intake valve lift sensor 160 based on a ratio of a predetermined voltage (e.g., 4.5 volts) to the learned voltage. For example, the sensor voltage normalization module 304 may multiply the output voltage of the intake valve lift sensor 160 by the ratio of the predetermined voltage to the learned voltage to normalize the output voltage. The predetermined voltage may be the output voltage of the intake valve lift sensor 160 when all of the components of the intake valvetrain 144 and the intake valve lift sensor 160 are nominal (e.g., manufactured according to design intent).

A valve lift determination module 306 determines the intake and exhaust valve lift based on the normalized output voltages of the intake and exhaust valve lift sensors 160 and 162, respectively. In one example, the valve lift determination module 306 determines the intake valve lift based on a ratio of a first period when the intake valve 122 is open to a sum of the first period and a second period when the intake valve 122 is closed. The first period may begin when the intake valve 122 starts to open and may end when the intake valve 122 is closed. The second period may begin when the intake valve 122 is initially closed and may end when the intake valve 122 starts to open.

The valve lift determination module 306 may determine the first period based on a number of samples taken from the intake valve lift signal 164 while the intake valve 122 is open and a corresponding sampling rate (e.g., 27 microseconds (μs)). For example, the valve lift determination module 306 may multiply the number of samples taken by the sampling rate to obtain the first period. The valve lift determination module 306 may determine the second period based on a number of samples taken from the valve lift signal while the valve is closed and the sampling rate. For example, the valve lift determination module 306 may multiply the number of samples taken by the sampling rate to obtain the second period.

The valve lift determination module 306 may determine that the intake valve 122 is open when the normalized output voltage of the intake valve lift sensor 160 is less than a first threshold. The valve lift determination module 306 may determine that the intake valve 122 is closed when the normalized output voltage of the intake valve lift sensor 160 is greater than a second threshold. The first threshold may be a first predetermined percent (e.g., 80 percent) of the learned voltage, and the second threshold may be a second predetermined percent (e.g., 85 percent) of the learned voltage. The second predetermined percent may be greater than the first predetermined percent.

The valve lift determination module 306 may convert the ratio of the first period to the sum of the first period and the second period into a percentage and determine the intake valve lift based on the percentage. For example, the valve lift determination module 306 may determine the intake valve lift based on a predetermined relationship between the percentage and the intake valve lift. The predetermined relationship may be embodied in a lookup table and/or an equation.

In another example, the valve lift determination module 306 may take samples of the normalized output voltage of the intake valve lift sensor 160 when the intake valve 122 is open and determine the intake valve lift based on the samples taken. The valve lift determination module 306 may determine the valve lift based on a sum of the differences between the sample voltages and the learned voltage. For example, the valve lift determination module 306 may determine the intake valve lift based on a predetermined relationship between the sum of the differences and the intake valve lift. The predetermined relationship may be embodied in a lookup table and/or an equation.

A fault detection module 308 detects a fault in the intake and exhaust valvetrains 144 and 146 based on the intake and exhaust valve lift, respectively. In one example, the fault detection module 308 detects a fault in the intake valvetrain 144 when the intake valve lift is outside of a valve lift range, which may include a maximum valve lift and/or a minimum valve lift. The fault detection module 308 may determine the valve lift range based on an intake valve lift command sent from a valve control module 310 to the valve actuator module 158 to control the intake valve lift. The fault detection module 308 may detect a fault in the intake valvetrain 144 when the intake valve lift is greater than the maximum valve lift and/or less than the minimum valve lift.

The fault detection module 308 may detect a fault in the intake and exhaust valvetrains 144 and 146 based on one or more parameters which may be used to determine the intake and exhaust valve lift, respectively. In one example, the fault detection module 308 may detect a fault in the intake valvetrain 144 based on the sum of the differences between the sample voltages and the learned voltage. In another example, the fault detection module 308 may detect a fault in the intake valvetrain 144 based on the ratio of the first period when the intake valve 122 is open to the sum of the first period and the second period when the intake valve 122 is closed.

Additionally or alternatively, the fault detection module 308 may detect a fault in the intake and exhaust valvetrains 144 and 146 based on the percentage corresponding to the ratio of the first period to sum of the first period and the second period. For example, the percentage may normally be a first percent (e.g., 27 percent) when the intake valvetrain 144 operates in the first lift state, and the percentage may normally be a second percent (e.g., 35 percent) when the intake valvetrain 144 operates in the second lift state. Thus, the fault detection module 308 may set a threshold for detecting a fault in the intake valvetrain 144 equal to a predetermined percentage between the first and second percentages (e.g., 31 percent). In turn, the fault detection module 308 may detect a fault in the intake valvetrain 144 when the intake valvetrain 144 is operating in the first lift state and the percentage corresponding to the ratio is greater than the predetermined percentage. Conversely, the fault detection module 308 may detect a fault in the intake valvetrain 144 when the intake valvetrain 144 is operating in the second lift state and the percentage corresponding to the ratio is less than the predetermined percentage. The fault detection module 308 may detect a fault in the exhaust valvetrain 146 in a similar manner.

The fault detection module 308 may activate the service indicator 194 when the fault detection module 308 detects a fault in the intake or exhaust valvetrain 144 or 146. In addition, the fault detection module 308 may set a diagnostic trouble code (DTC) and/or generate a signal indicating when the fault detection module 308 detects a fault in the intake or exhaust valvetrain 144 or 146.

The valve control module 310 outputs a desired valve lift to the valve actuator module 158 indicating a desired lift state. A throttle control module 312 sends a signal to the throttle actuator module 116 indicating a desired throttle area. A fuel control module 314 sends a signal to the fuel actuator module 124 indicating a desired fuel injection timing and/or a desired fuel injection amount. A spark control module 316 sends a signal to the spark actuator module 126 indicating a desired spark timing.

The valve control module 310, the throttle control module 312, the fuel control module 314, and/or the spark control module 316 may take one or more remedial actions when a fault in the intake or exhaust valvetrain 144 or 146 is detected. In one example, the valve control module 310 set the desired lift state to a default lift state such as the second lift state. In another example, the throttle control module 312, the fuel control module 314, and the spark control module 316 may adjust the intake airflow, fuel delivery, and spark generation to limit the engine speed and/or the torque output of the engine 102.

Figure 4:
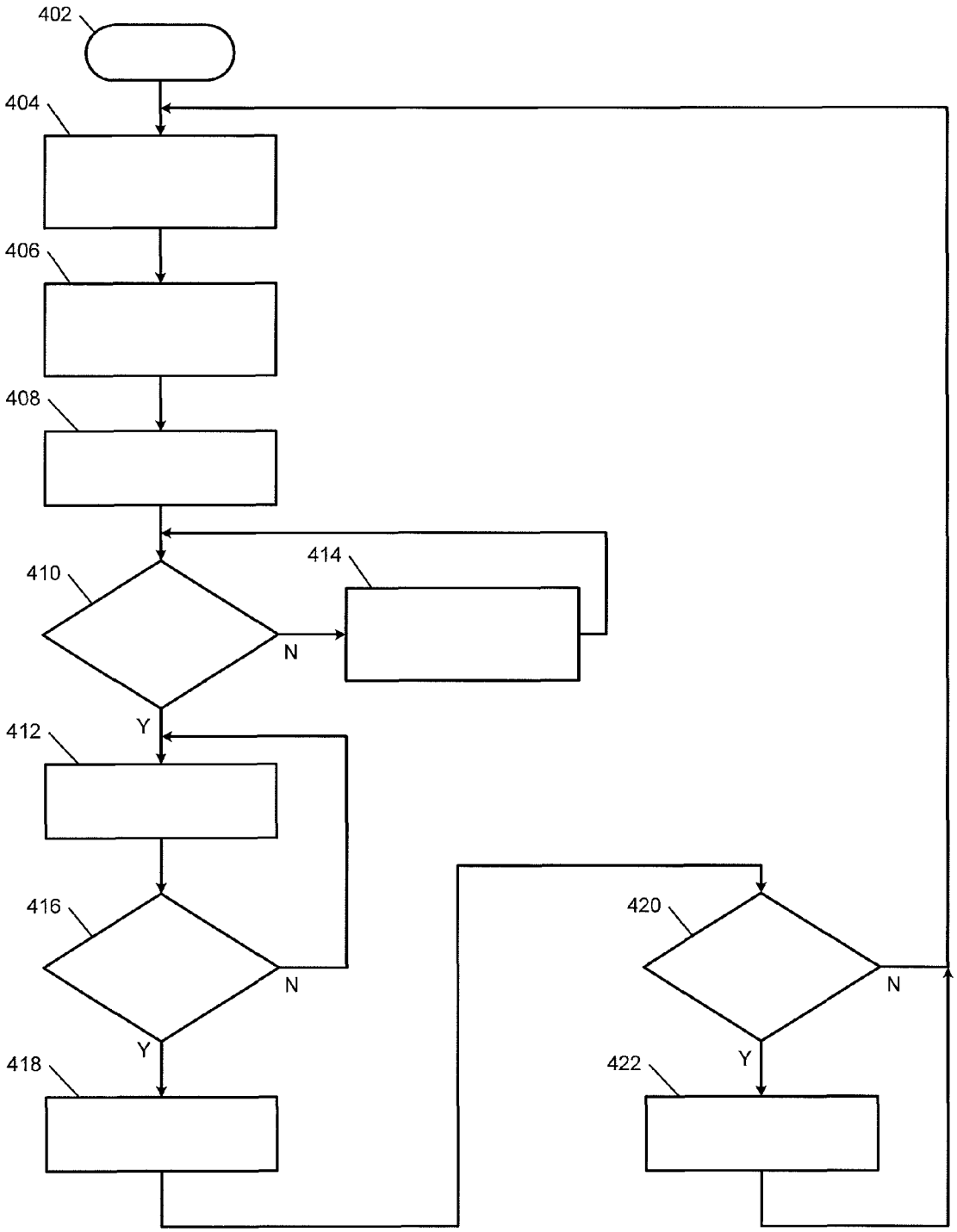
FIGS. 4 and 5 are flowcharts illustrating example control methods according to the principles of the present disclosure.

Referring now to FIG. 4, a first method for measuring valve lift and for detecting a fault in a valvetrain based on the valve lift begins at 402. At 404, the method determines or learns the output voltage of a valve lift sensor when a valve is closed. For example, the method may take samples from the output voltage of the valve lift sensor over a predetermined period (e.g., 2 seconds). The output voltage of the valve lift sensor may increase as the valve closes. Thus, the method may learn the output voltage of the valve lift sensor based on (an average of) a predetermined number (e.g., 50) of the samples that are greater than all of the other samples.

At 406, the method determines a first threshold for determining when the valve is open and a second threshold for determining when the valve is closed. The first threshold may be a first predetermined percent (e.g., 80 percent) of the learned voltage, and the second threshold may be a second predetermined percent (e.g., 85 percent) of the learned voltage. The second predetermined percent may be greater than the first predetermined percent.

At 408, the method normalizes the output voltage of the valve lift sensor. The method may normalize the output voltage of the valve lift sensor based on a ratio of a predetermined voltage (e.g., 4.5 volts) to the learned voltage. For example, the method may multiply the output voltage of the intake valve lift sensor by the ratio of the predetermined voltage to the learned voltage to normalize the output voltage. The predetermined voltage may be the output voltage of the valve lift sensor when all of the components of the valvetrain and the valve lift sensor are nominal. The method may learn and normalize the output voltage of the valve lift sensor once per key cycle or multiple times per key cycle. A key cycle starts when an ignition switch is switched from off to run and ends when the ignition switch is switched from run to off.

At 410, the method determines whether the valve is open. The method may determine that the valve is open when the normalized output voltage of the valve lift sensor is less than the first threshold. If the valve is open, the method continues at 412. Otherwise, the method continues at 414.

At 412, the method determines a first period when the valve is open. The first period may begin when the valve starts to open and may end when the valve is closed. The method may determine the first period based on a number of samples taken from the valve lift signal while the valve is open and a corresponding sampling rate (e.g., 27 μs). For example, the method may multiply the number of samples taken by the sampling rate to obtain the first period.

At 414, the method determines a second period when the valve is closed. The second period may begin when the intake valve 122 is initially closed and may end when the intake valve 122 starts to open. The method may determine the second period based on a number of samples taken from the valve lift signal while the valve is closed and the sampling rate. For example, the method may multiply the number of samples taken by the sampling rate to obtain the second period.

At 416, the method determines whether the valve is closed. The method may determine that the valve is closed when the normalized output voltage of the valve lift sensor is greater than the second threshold. If the valve if closed, the method continues at 418. Otherwise, the method continues at 412.

At 418, the method determines the valve lift. The method may determine the valve lift based on a ratio of the first period when the valve is open to a sum of the first period and the second period when the valve is closed. The method may convert the ratio of the first period to the sum of the first period and the second period into a percentage and determine the intake valve lift based on the percentage. For example, the valve lift determination module 306 may determine the intake valve lift based on a predetermined relationship between the percentage and the intake valve lift. The predetermined relationship may be embodied in a lookup table and/or an equation.

At 420, the method determines whether the valve lift is outside of a valve lift range. The valve lift range may include a maximum valve lift and/or a minimum valve lift. The method may determine the valve lift range based on a valve lift command that is sent to the valvetrain to control the valve lift. If the valve lift is outside of the valve lift range, the method continues at 422. Otherwise, the method continues at 404.

At 422, the method detects a fault in the valvetrain. In addition, the method may set a diagnostic trouble code (DTC), limit the torque output of the engine, and/or limit the speed of the engine. Further, the method may set a desired lift state of the valvetrain to a default lift state. For example, the valvetrain may be a two-step valvetrain that operates in a high lift state or a low lift state, and the default lift state may be the high lift state.

Figure 5:
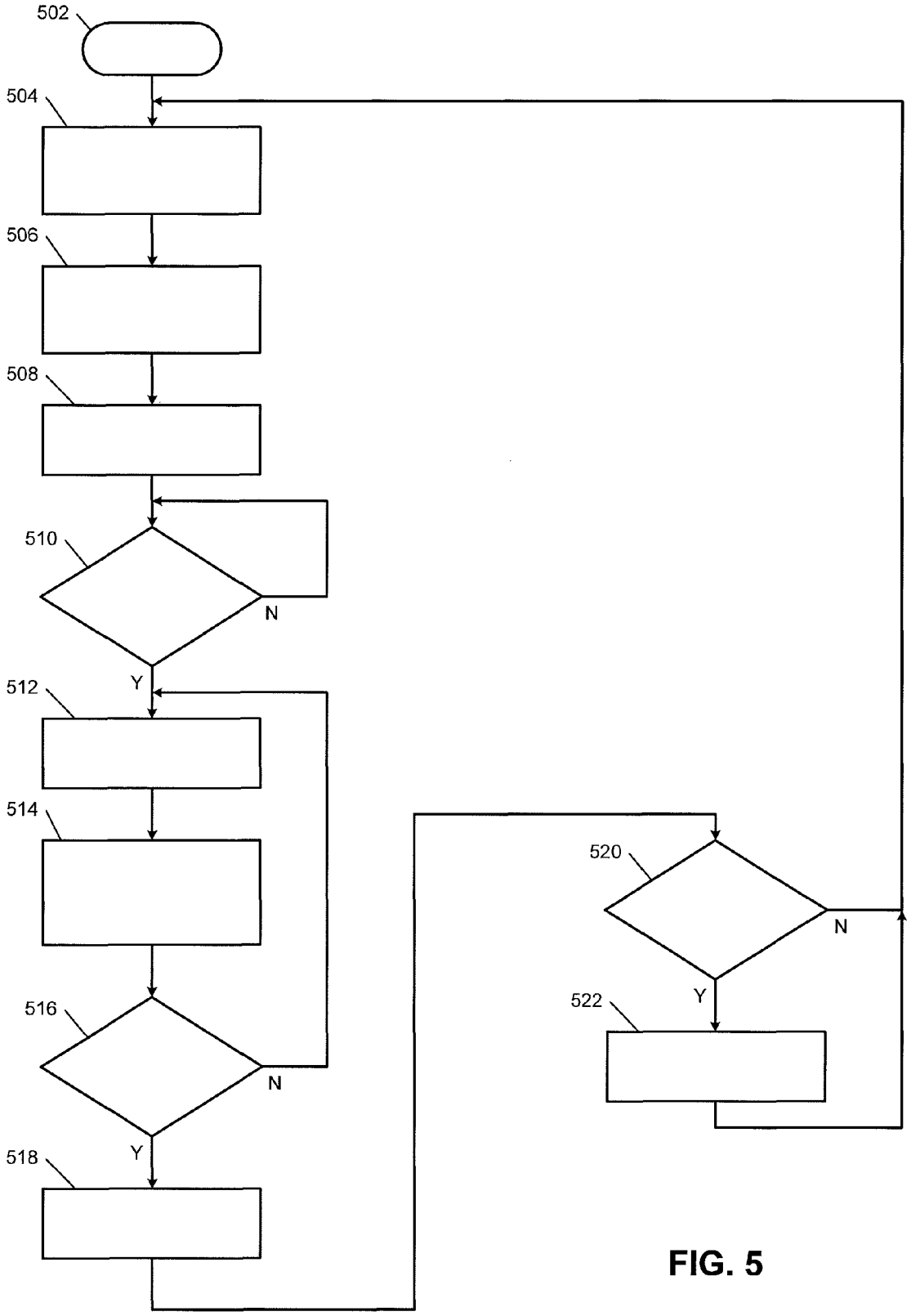

Referring now to FIG. 5, a second method for measuring valve lift and for detecting a fault in a valvetrain based on the valve lift begins at 502. At 504, the method determines or learns the output voltage of a valve lift sensor when a valve is closed. For example, the method may take samples from the output voltage of the valve lift sensor over a predetermined period (e.g., 2 seconds). The output voltage of the valve lift sensor may increase as the valve closes. Thus, the method may learn the output voltage of the valve lift sensor based on (an average of) a predetermined number (e.g., 50) of the samples that are greater than all of the other samples.

At 506, the method determines a first threshold for determining when the valve is open and a second threshold for determining when the valve is closed. The first threshold may be a first predetermined percent (e.g., 80 percent) of the learned voltage, and the second threshold may be a second predetermined percent (e.g., 85 percent) of the learned voltage. The second predetermined percent may be greater than the first predetermined percent.

At 508, the method normalizes the output voltage of the valve lift sensor. The method may normalize the output voltage of the valve lift sensor based on a ratio of a predetermined voltage (e.g., 4.5 volts) to the learned voltage. For example, the method may multiply the output voltage of the intake valve lift sensor by the ratio of the predetermined voltage to the learned voltage to normalize the output voltage. The predetermined voltage may be the output voltage of the valve lift sensor when all of the components of the valvetrain and the valve lift sensor are nominal. The method may learn and normalize the output voltage of the valve lift sensor once per key cycle or multiple times per key cycle. A key cycle starts when an ignition switch is switched from off to run and ends when the ignition switch is switched from run to off.

At 510, the method determines whether the valve is open. The method may determine that the valve is open when the normalized output voltage of the valve lift sensor is less than the first threshold. If the valve if open, the method continues at 512. Otherwise, the method continues to determine whether the valve is open at 510.

At 512, the method takes samples of the normalized output voltage of the valve lift sensor when the valve is open. In various implementations, the methods of FIGS. 4 and 5 may continuously sample the output voltage of the valve lift sensor. For example, the methods may sample the output voltage of the valve lift sensor at a predetermined rate when the ignition switch is switched to run. In addition, the methods may learn the output voltage of the valve lift sensor based on the samples taken. Thus, the method of FIG. 5 may sample the output voltage of the valve lift sensor at 512 before the method learns the output voltage of the valve lift sensor at 504.

At 514, the method determines a sum of the differences between the sample voltages and the learned voltage. At 516, the method determines whether the valve is closed. The method may determine that the valve is closed when the normalized output voltage of the valve lift sensor is greater than the second threshold. If the valve is closed, the method continues at 518. Otherwise, the method continues at 512.

At 518, the method determines the valve lift. The method may determine the valve lift based on a sum of the differences between the sample voltages and the learned voltage. For example, the method may determine the valve lift based on a predetermined relationship between the sum of the differences and the valve lift. The predetermined relationship may be embodied in a lookup table and/or an equation.

At 520, the method determines whether the valve lift is outside of a valve lift range. The valve lift range may include a maximum valve lift and/or a minimum valve lift. The method may determine the valve lift range based on a valve lift command that is sent to the valvetrain to control the valve lift. If the valve lift is outside of the valve lift range, the method continues at 522. Otherwise, the method continues at 504.

At 522, the method detects a fault in the valvetrain. In addition, the method may set a diagnostic trouble code (DTC), limit the torque output of the engine, and/or limit the speed of the engine. Further, the method may set a desired lift state of the valvetrain to a default lift state. For example, the valvetrain may be a two-step valvetrain that operates in a high lift state or a low lift state, and the default lift state may be the high lift state.

Figure 6:
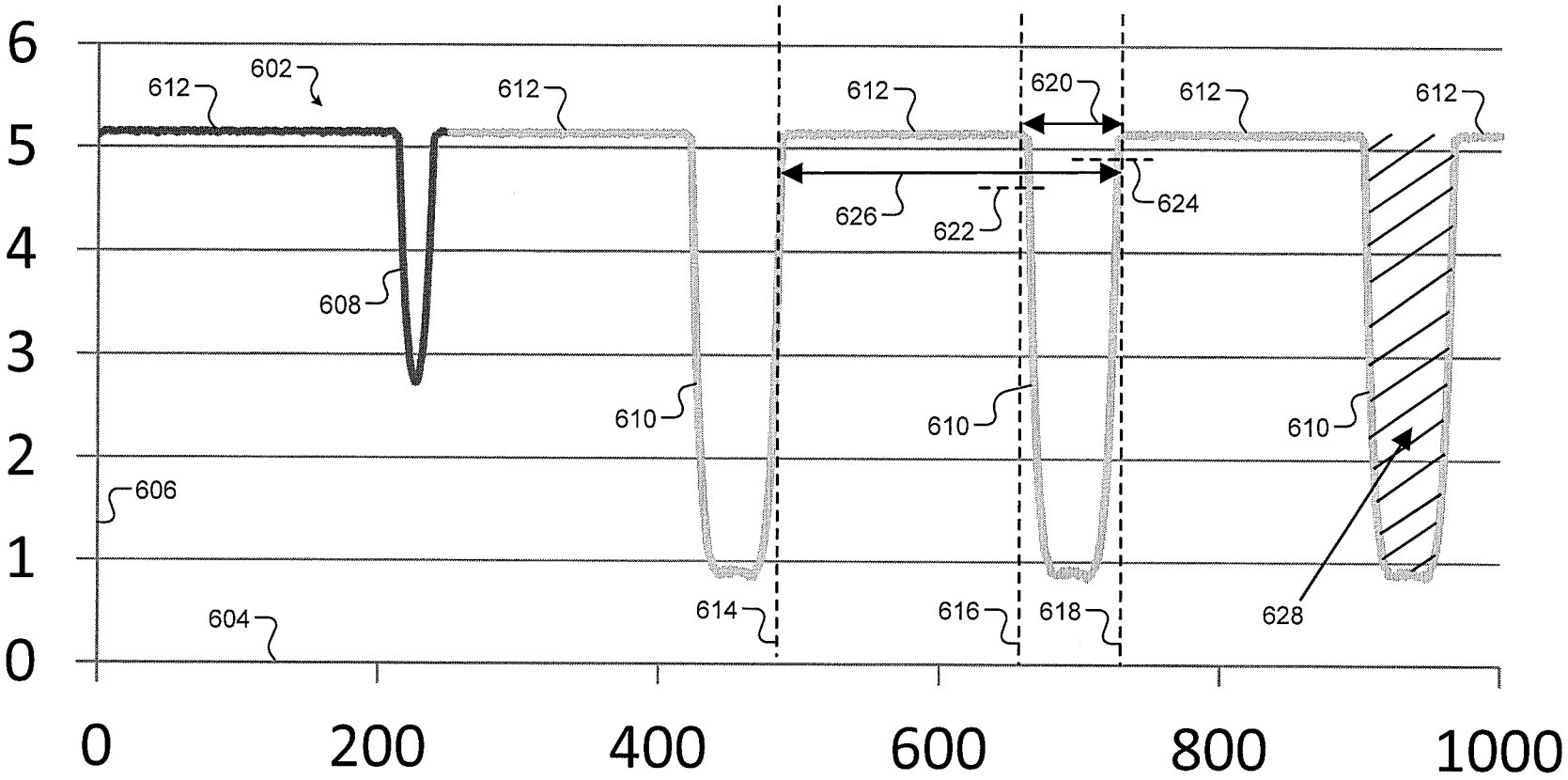
FIG. 6 is a graph illustrating an example valve lift signal according to the principles of the present disclosure.

Referring now to FIG. 6, a valve lift signal 602 is plotted with respect to an x-axis 604 that represents time in milliseconds (ms) and a y-axis 606 that represents voltage in volts. The valve lift signal 602 indicates the amount by which a two-step valvetrain lifts a valve of an engine. The valve lift signal 602 decreases when the valve is open. Thus, a low lift event is shown at 608, and high lift events are shown at 610, and the valve is closed at 612.

At 614, the valve is initially closed after the first one of the high lift events 610. At 616, the valve starts to open as the second one of the high lift events 610 begins. At 618, the valve closes as the second one of the high lift events ends. Thus, the valve is open during a first period 620 from 616 to 618, and the valve is closed during a second period from 614 to 616.

The system and method may determine that the valve is open when the valve lift signal 602 is less than a first threshold 622. The first threshold 622 may be a first predetermined percentage of the learned voltage. The system and method may determine that the valve is closed when the valve lift signal 602 is greater than a second threshold 624. The second threshold 624 may be a second predetermined percentage of the learned voltage. The second predetermined percentage may be greater than the first predetermined percentage.

A system and method according to the present disclosure may learn the voltage indicated by the valve lift signal 602 when the valve is closed. The system and method may multiply the valve lift signal 602 by a ratio of a nominal voltage to the learned voltage to normalize the valve lift signal 602. For example, the voltage indicated by the valve lift signal 602 when the valve is closed may initially be 3.5 volts, and the voltage may be shifted up to about 5 volts as shown after the voltage is normalized.

The system and method determines the valve lift based on a ratio of the first period to a total period 626 equal to a sum of the first period 620 and the second period. In another example, the system and method takes samples of the valve lift signal 602 during the first period and determines the valve lift based on a sum of the differences between the samples and the learned voltage. In some cases, the system and method may multiply each difference by a corresponding sampling period to obtain an area 628 within the curve representing each of the low and high lift events 608 and 610. The system and method may then determine the valve lift based on the area 628.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. As used herein, the phrase at least one of A, B, and C should be construed to mean a logical (A or B or C), using a non-exclusive logical OR. It should be understood that one or more steps within a method may be executed in different order (or concurrently) without altering the principles of the present disclosure.

In this application, including the definitions below, the term module may be replaced with the term circuit. The term module may refer to, be part of, or include an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor (shared, dedicated, or group) that executes code; memory (shared, dedicated, or group) that stores code executed by a processor; other suitable hardware components that provide the described functionality; or a combination of some or all of the above, such as in a system-on-chip.

The term code, as used above, may include software, firmware, and/or microcode, and may refer to programs, routines, functions, classes, and/or objects. The term shared processor encompasses a single processor that executes some or all code from multiple modules. The term group processor encompasses a processor that, in combination with additional processors, executes some or all code from one or more modules. The term shared memory encompasses a single memory that stores some or all code from multiple modules. The term group memory encompasses a memory that, in combination with additional memories, stores some or all code from one or more modules. The term memory may be a subset of the term computer-readable medium. The term computer-readable medium does not encompass transitory electrical and electromagnetic signals propagating through a medium, and may therefore be considered tangible and non-transitory. Non-limiting examples of a non-transitory tangible computer readable medium include nonvolatile memory, volatile memory, magnetic storage, and optical storage.

The apparatuses and methods described in this application may be partially or fully implemented by one or more computer programs executed by one or more processors. The computer programs include processor-executable instructions that are stored on at least one non-transitory tangible computer readable medium. The computer programs may also include and/or rely on stored data.

What is claimed is:

1. A system comprising:

a valve lift determination module that:

obtains samples of a valve lift signal generated by a valve lift sensor;

determines whether a valve is open or closed based on a magnitude of the samples;

determines a first period for which the valve is open based on a number of the samples obtained while the valve is open and a corresponding sampling rate; and determines valve lift based on the first period, wherein the valve lift is an amount by which the valve is lifted; and a fault detection module that detects a fault in a valve actuator based on the valve lift.

2. The system of claim 1 wherein the fault detection module detects a fault in the valve actuator when the valve lift is outside of a valve lift range.

3. The system of claim 2 further comprising a valve control module that controls the valve actuator, wherein the fault detection module determines the valve lift range based on a valve lift command that the valve control module sends to the valve actuator.

4. The system of claim 1 wherein the valve includes at least one of an intake valve of an engine and an exhaust valve of the engine.

5. The system of claim 1 further comprising a valve control module that controls the valve actuator based on a default state when a fault in the valve actuator is detected.

6. The system of claim 1 wherein the valve lift determination module:

determines a second period for which the valve is closed based on a number of the samples obtained while the valve is closed and the sampling rate; and determines the valve lift based on the first period for which the valve is open and the second period for which the valve is closed.

7. The system of claim 6 wherein the valve lift determination module determines the valve lift based on a ratio of the first period to a sum of the first period and the second period.

8. The system of claim 7 further comprising a sensor voltage determination module that determines an output voltage of the valve lift sensor when the valve is closed based on a predetermined number of samples that are taken from the valve lift signal over a predetermined period and that are greater than other samples taken from the valve lift signal during the predetermined period.

9. The system of claim 8 further comprising a sensor voltage normalization module that normalizes the output voltage of the valve lift sensor by multiplying the output voltage by a ratio of a predetermined voltage to the output voltage when the valve is closed, wherein the valve lift determination module determines whether the valve is open or closed based on the normalized output voltage.

10. The system of claim 8 wherein the valve lift determination module:

determines first and second thresholds based on the output voltage when the valve is closed;

determines that the valve is open when the output voltage of the valve lift sensor is less than the first threshold; and determines that the valve is closed when the output voltage is greater than the second threshold, wherein the second threshold is greater than the first threshold.

11. The system of claim 1 further comprising an engine actuator control module that adjusts operation of an engine actuator based on whether a fault in the valve actuator is detected.

12. A method comprising:

obtaining samples of a valve lift signal generated by a valve lift sensor;

determining whether a valve is open or closed based on a magnitude of the samples;

determining a first period for which the valve is open based on a number of the samples obtained while the valve is open and a corresponding sampling rate;

determining valve lift based on the first period, wherein the valve lift is an amount by which the valve is lifted; and detecting a fault in a valve actuator based on the valve lift.

13. The method of claim 12 further comprising detecting a fault in the valve actuator when the valve lift is outside of a valve lift range.

14. The method of claim 13 further comprising determining the valve lift range based on a valve lift command that is sent to the valve actuator.

15. The method of claim 12 wherein the valve includes at least one of an intake valve of an engine and an exhaust valve of the engine.

16. The method of claim 12 further comprising controlling the valve actuator based on a default state when a fault in the valve actuator is detected.

17. The method of claim 12 further comprising:

determining a second period for which the valve is closed based on a number of the samples obtained while the valve is closed and the sampling rate; and determining the valve lift based on the first period for which the valve is open and the second period for which the valve is closed.

18. The method of claim 17 further comprising determining the valve lift based on a ratio of the first period to a sum of the first period and the second period.

19. The method of claim 18 further comprising determining an output voltage of the valve lift sensor when the valve is closed based on a predetermined number of samples that are taken from the valve lift signal over a predetermined period and that are greater than other samples taken from the valve lift signal during the predetermined period.

20. The method of claim 19 further comprising:

normalizing the output voltage of the valve lift sensor by multiplying the output voltage by a ratio of a predetermined voltage to the output voltage when the valve is closed; and determining whether the valve is open or closed based on the normalized output voltage.

21. The method of claim 19 further comprising:

determining first and second thresholds based on the output voltage when the valve is closed;

determining that the valve is open when the output voltage of the valve lift sensor is less than the first threshold; and determining that the valve is closed when the output voltage is greater than the second threshold, wherein the second threshold is greater than the first threshold.

22. The method of claim 12 further comprising adjusting operation of an engine actuator based on whether a fault in the valve actuator is detected.

23. A system comprising:

a valve lift determination module that:

obtains L samples of a valve lift signal when a valve is closed;

obtains M samples of the valve lift signal when the valve is open; and determines valve lift based on N differences between the L samples of the valve lift signal and the M samples of the valve lift signal, wherein the valve lift is an amount by which the valve is lifted, and L, M, and N are integers greater than one; and a fault detection module that detects a fault in a valve actuator based on the valve lift.

24. The system of claim 23 wherein the valve lift determination module determines the valve lift based on a sum of the N differences between the L samples of the valve lift signal and the M samples of the valve lift signal.

25. The system of claim 23 further comprising an engine actuator control module that adjusts operation of an engine actuator based on whether a fault in the valve actuator is detected.

26. A method comprising:

obtaining L samples of a valve lift signal when a valve is closed;

obtaining M samples of the valve lift signal when the valve is open;

determining valve lift based on N differences between the L samples of the valve lift signal and the M samples of the valve lift signal, wherein the valve lift is an amount by which the valve is lifted, and L, M, and N are integers greater than one; and a fault detection module that detects a fault in a valve actuator based on the valve lift.

27. The method of claim 26 further comprising determining the valve lift based on a sum of the N differences between the L samples of the valve lift signal and the M samples of the valve lift signal.

28. The method of claim 26 further comprising adjusting operation of an engine actuator based on whether a fault in the valve actuator is detected.

* * * * *